US006637676B2

(12) United States Patent
Zieger et al.

(10) Patent No.: US 6,637,676 B2
(45) Date of Patent: Oct. 28, 2003

(54) ILLUMINATED SHOWERHEAD

(75) Inventors: Claus D. Zieger, City of Industry, CA (US); Hennig Zieger, City of Industry, CA (US)

(73) Assignee: Interbath, Inc., City of Industry, CA (US)

( * ) Notice: Subject to any disclaimer, the term of this patent is extended or adjusted under 35 U.S.C. 154(b) by 0 days.

(21) Appl. No.: 09/843,623

(22) Filed: Apr. 27, 2001

(65) Prior Publication Data

US 2002/0158153 A1 Oct. 31, 2002

(51) Int. Cl.[7] ..... B05B 1/14; F21V 33/00

(52) U.S. Cl. ..... 239/548; 239/18; 239/289; 362/96; 362/234; 362/555

(58) Field of Search ..... 239/17, 18, 211, 239/289, 548, 19; 362/96, 227, 234, 551, 555; 607/80

(56) References Cited

U.S. PATENT DOCUMENTS 3,104,815 A * 9/1963 Schultz ..... 239/19
3,845,291 A 10/1974 Portyrata
4,130,120 A * 12/1978 Kohler, Jr. ..... 607/80
4,564,889 A 1/1986 Bolson
4,616,298 A 10/1986 Bolson
4,749,126 A * 6/1988 Kessener et al. ..... 362/96
4,998,673 A * 3/1991 Pilolla ..... 239/67
5,171,429 A * 12/1992 Yasuo ..... 362/555
5,207,499 A * 5/1993 Vajda et al. ..... 239/18
5,539,624 A 7/1996 Dougherty
5,552,973 A 9/1996 Hsu
5,823,431 A 10/1998 Pierce
5,873,647 A * 2/1999 Kurtz et al. ..... 362/96
5,918,809 A * 7/1999 Simmons ..... 239/17
6,021,960 A 2/2000 Kehat
6,126,290 A * 10/2000 Veigel ..... 239/18
6,375,342 B1 * 4/2002 Koren et al. ..... 239/18
6,484,952 B2 * 11/2002 Koren ..... 239/18

* cited by examiner

*Primary Examiner*—Steven J. Ganey
(74) *Attorney, Agent, or Firm*—Foley & Lardner

(57) ABSTRACT

A showerhead which may be utilized as a source of illumination includes a source of illumination which is efficiently coupled to individual ones of a plurality of water sprays. In an exemplary embodiment, a plurality of fiber-optic members transmit light from one or more individual light sources to corresponding ones of a plurality of individual shower sprays or nozzles. Light from the source of illumination is thus transferred to and is transmitted through a plurality of individual water sprays.

6 Claims, 4 Drawing Sheets

ILLUMINATED SHOWERHEAD

BACKGROUND OF THE INVENTION

1. Field of the Invention

The present invention relates generally to the field of shower fixtures and water spraying mechanisms. More specifically, the present invention is directed to shower heads and fixtures which include, sources of illumination to incorporate light into the streams of water flowing from the shower head or water spraying mechanisms.

2. Description of the Related Art

There are currently a wide variety showerhead and water spraying fixtures which are commercially available and known in the prior art. Known showerhead devices and water spray mechanisms include both handheld and fixed devices. The wide variety of known showerhead water spray fixtures includes mechanisms for adjusting both the type of spray as well as the amount water flowing through the device. The market for high-end showerhead devices and water spray mechanisms is highly competitive and manufacturers are continuously looking for unique features which will distinguish their products from those of their competitors and which will entice consumers to purchase new products.

The majority of recent advances in this field have primarily centered around the ornamental characteristics of the fixture or showerhead. While these innovations have resulted in unique and distinctive designs for shower heads, there still remains a need in the field for unique features which will distinguish products and provide desirable advantages to consumers.

One recent advance in this field is disclosed in U.S. Pat. No. 6,021,960. This patent reference describes a colored light showerhead wherein a light source is incorporated into the showerhead fixture. As shown in the '960 patent, the light source transmits light in the general direction of the water spray. While the device disclosed in the '960 patent discloses one way in which a source of illumination may be combined with a shower spraying device, there remains a need in the art for improvements in the way in which a source illumination may be coupled to water spray mechanisms in order to improve the transmission of light through water sprays of the showerhead. Specifically, for example, the device disclosed in the '960 patent as illustrated in FIG. 4 provides a common cavity in which water is received from a water source. The common cavity includes at least one wall with a plurality of holes for spraying water. The light source is located within the common cavity and generates light for transmission with each of the water sprays. Essentially, as shown in the '960 patent, each of the water sprays is used as a conduit for transmitting light from the common cavity. At least one problem with this design is that it is inefficient in the transmission of light because the common cavity generally receives light from the source of illumination and there is no direct coupling to each of the shower sprays or openings through which water is transmitted.

The inventors of the present application have recognized that light sources may be coupled to individual water sprays of a showerhead in order to provide a distinctive and highly desirable water spray. Currently there are no shower heads or water spraying devices which incorporate light sources which transmit light from a source illumination directly through individual conduits to a corresponding plurality of water, sources or sprays in order to improve the transmission of light from a source of illumination into each of a plurality of water sprays. Accordingly, there remains a need in the field for a new showerhead and water spray mechanisms which incorporate additional sources of illumination for transmitting light from a source of illumination directly to a water streams of a showerhead.

One object and advantage of the present invention is to provide a showerhead which may be utilized as a source of illumination wherein light from a source of illumination may be efficiently coupled to individual ones of a plurality of water sprays. Another object and advantage of the present invention is to provide a showerhead which may be utilized as a source of illumination wherein a plurality of individual light sources are directly coupled with corresponding individual water sprays. Other objects, features and advantages of the present invention will become readily apparent in light of the following summary and detailed description.

SUMMARY OF THE INVENTION

In accordance with one and exemplary embodiment of the present invention, a showerhead incorporates at least one source of illumination for providing light which is then subsequently transmitted through a plurality of fiber-optic or other light transmission channels to a corresponding plurality of water outlet channels. Specifically, the light transmission channels preferably terminate at or near the shower sprays. The light traveling through the light transmission channels is accordingly coupled to the individual water sprays so that light transmitted from the light source may be transmitted through the individual water spray paths.

In accordance with another alternate exemplary embodiment of the present invention, a plurality of light sources are preferably located near or adjacent to a corresponding plurality of water outlet paths or individual shower sprays. Light generated by the plurality of light sources is preferably coupled to the water adjacent the water outlet paths or individual shower sprays. As in the first embodiment, the individual shower sprays provide conduits for the transmission of light from the showerhead.

The present invention provides a plurality of water sources or sprays which simultaneously provide illumination in a novel and interesting manner. Additionally, in accordance with the present invention light from one or a plurality of individual light sources is efficiently coupled with each one of a plurality of individual water transmission paths or sprays. As a result, less electrical energy may be utilized by the shower system of the present invention.

DETAILED DESCRIPTION OF THE PRESENTLY PREFERRED EMBODIMENTS

Figure 1:
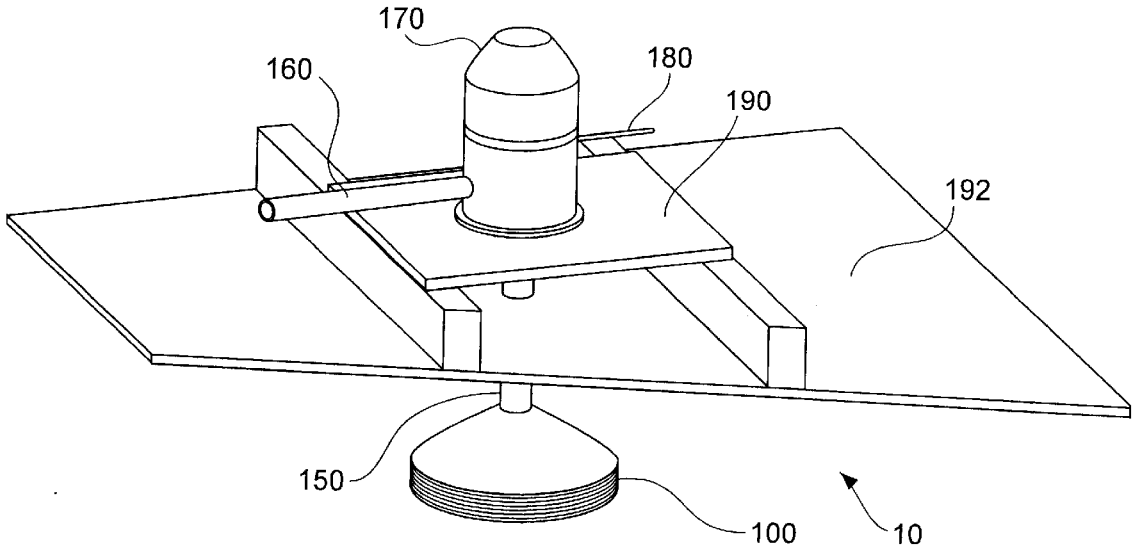
FIG. 1 illustrates a first exemplary embodiment of the present invention.

FIG. 1 illustrates a first exemplary embodiment of the present invention which is shown generally at 10. As shown in FIG. 1, a showerhead 100 is supported from above and supplied with water via a supply pipe 150. A standard water supply pipe or plumbing line 160 supplies water to the showerhead and fixture assembly. A light source is located within fixture assembly 170 and provides a source of illumination which generates light that is transmitted through showerhead 100. Electrical power is supplied to the light source 170 through a typical electrical wire 180. A support plate 190 may be used to secure the showerhead and fixture assembly in the ceiling of a shower stall. As shown in FIG. 1, the support plate 190 may be secured to conventional ceiling joists or other supports above the shower ceiling 192.

Figure 2:
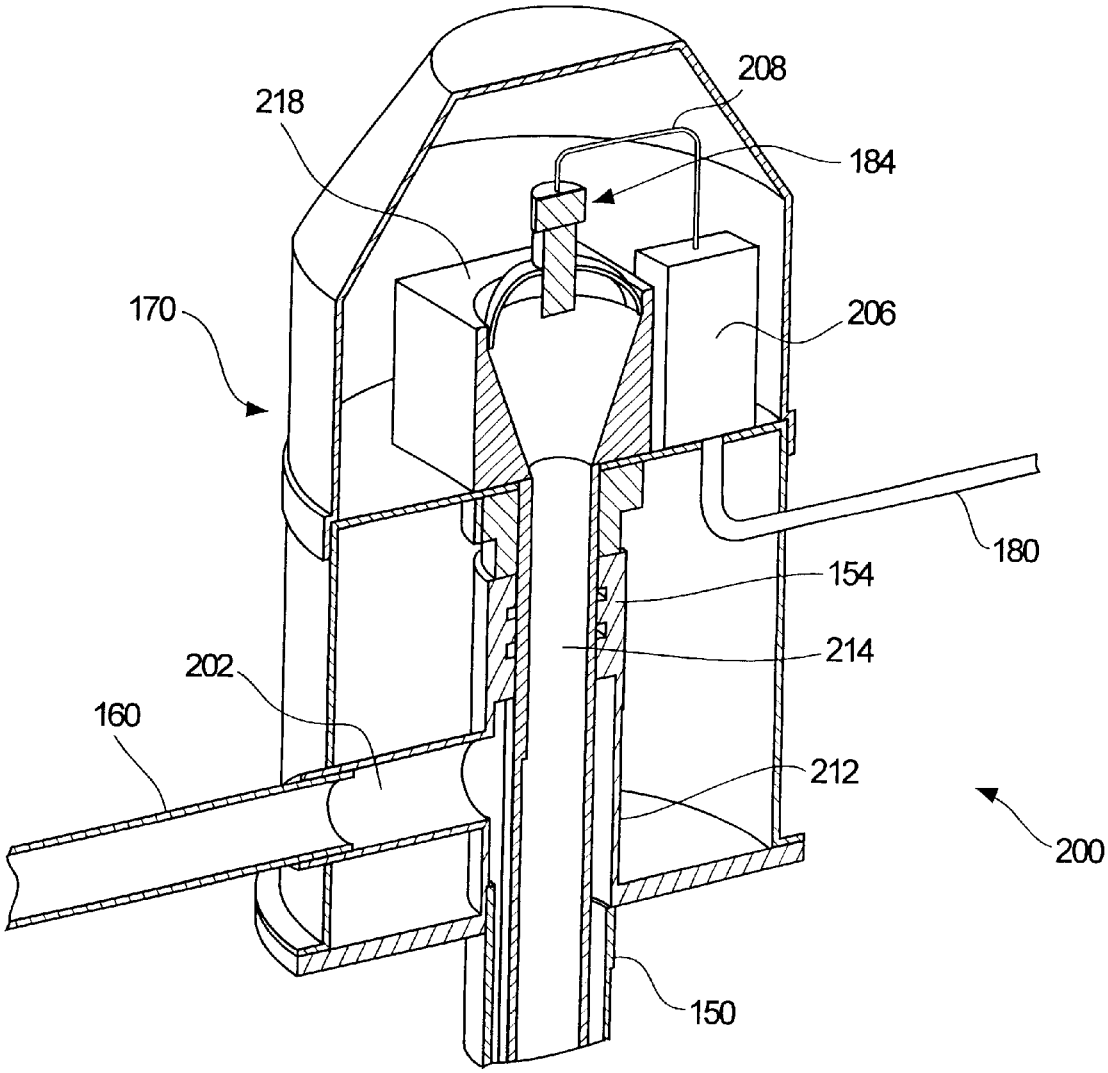
FIG. 2 illustrates the details of a light generating portion of a first exemplary embodiment of the present invention.

FIG. 2 illustrates the details of the shower head fixture assembly which is shown generally at 200. As shown in FIG. 2, supply line 160 may be connected to the showerhead fixture assembly 170 the connection type 202. Electrical line 180 transmits AC line voltage to the AC to DC converter 206. AC to DC converter 206 provides a low voltage DC output 208. A showerhead fixture foundation tee 212 provides the foundation support for the showerhead with integrated light. This tee structure element is the primary conduit for both water and light. A solid core fiber 214 is preferably pre-assembled within the fixture foundation tee 212. A solid core fiber 214 has an end which is adjacent to a light source 218.

The light source 218 generates light which is transmitted through the solid core fiber 214. The light source 218 may be any type of lamp or light emitting device. It is preferred the lamp be a high-intensity source in order to provide sufficient light for transmission through the water paths. In the preferred exemplary embodiment, light source 218 has a bottom end within an opening diameter that is smaller than the external diameter of the solid core fiber 214. However, it should be recognized that the size of the light source outlet and the fiber-optic conduit may be the same or the light source may be even greater in size than the solid core fiber 214. The solid core fiber 214 may also be substituted by a plurality of individual fiber-optic transmission lines. The bottom portion of the foundation tee 212 is water conduit 150 as shown in FIG. 1. The solid core fiber 214 extends through water conduit 150 as shown in FIG. 2. In the preferred exemplary embodiment, a clear plastic lens may be used to ensure a watertight seal. In such an embodiment, the lens member may be compression fit with a surrounding gasket of compressible material in order to form the watertight seal. Those skilled the art will appreciate this desirable in order to prevent water from undesirably leaking from the showerhead.

Figure 3:
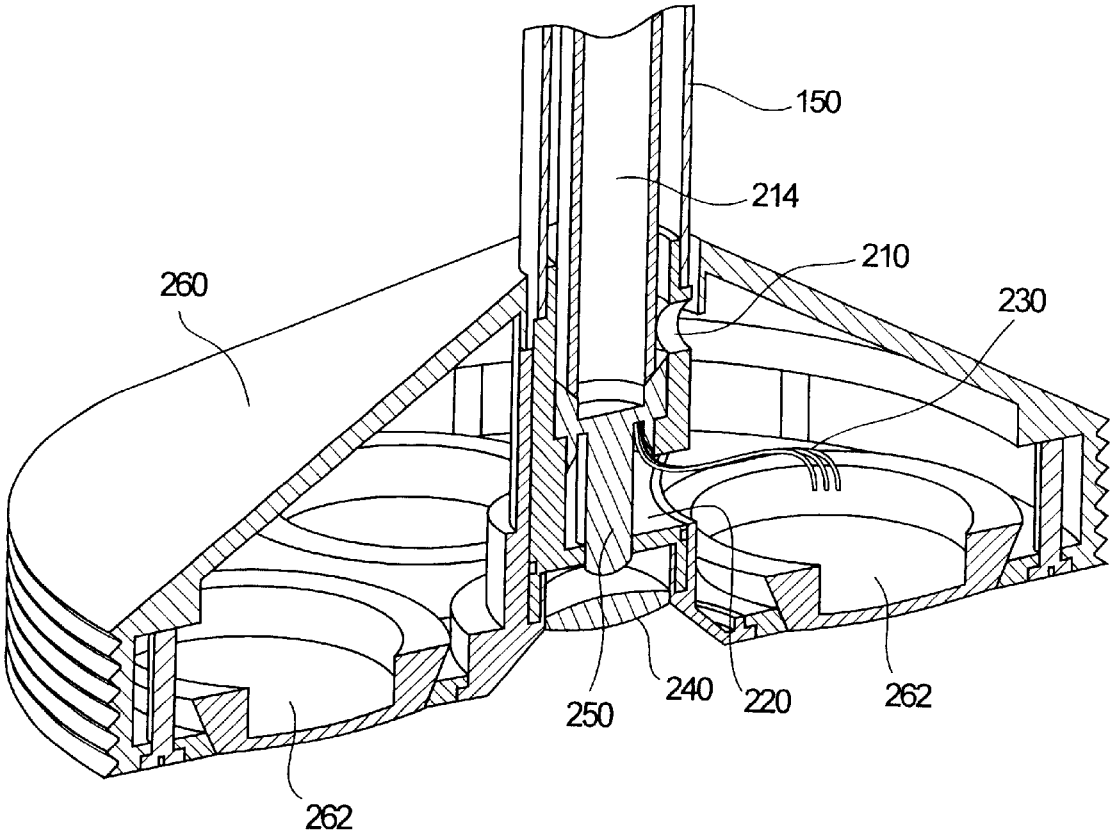
FIG. 3 illustrates the details of a light transmission portion of the first exemplary embodiment of the present invention.

FIG. 3 illustrates the details of the connection between individual fiber-optic elements 230 and the solid core fiber 214. A guiding cup 250 provides for termination of the solid core fiber 214. The solid core fiber 214 is a conventional device which may be purchased from, for example, Lumenyte, Inc. of Irvine Calif. The solid core fiber 214 is preferably an end-emitting type. These types of fibers have an opaque outer sheath which reduces the amount of light that is lost through this device. The end of the solid core fiber 214 may have the outer sheath removed in order to allow a better fit with guiding cup 250. When the showerhead is attached to the supply pipe, the solid core fiber 214 rests within the guiding cup therefore allowing light to pass through into the showerhead and through the water streams. In the preferred exemplary embodiment, the guiding cup 250 is preferably shaped in order to allow for mating with a plurality of smaller fiber-optic strands 230 which provide the direct transfer of light from the guiding cup 250 directly to individual water streams.

In the preferred exemplary embodiment, a lower portion of the guiding cup 250 mates with a lens 240 for transferring light from the showerhead 260. FIG. 3 also illustrates individual shower nozzles 262 which each provide a plurality of individual shower spray nozzles which have not been shown for the sake of convenience. The details of the actual connection between the ends of the individual fiber-optic strands 230 and individual sprays of the shower nozzles 262 is described below. Those skilled in the art will appreciate that water flows through conduit 150 along the sides of solid core fiber 214. The water then flows into a cavity of the showerhead 260 from which it is then transmitted into each of a plurality of individual sprays. The cavity is preferably watertight and contains individual fiber-optic strands 230 as well as the guiding cup 250 and the connections between the individual fiber-optic strands 230 and water sprays as well as the guiding cup 250.

Those skilled in the art will readily recognized that the guiding cup 250 must be comprised of a transparent material to allow light to be readily transmitted therethrough. Accordingly, the fiber-optic strands, guiding cup 250 and solid core fiber may all be comprised of either glass or transparent plastic or any other suitable material.

Figure 4:
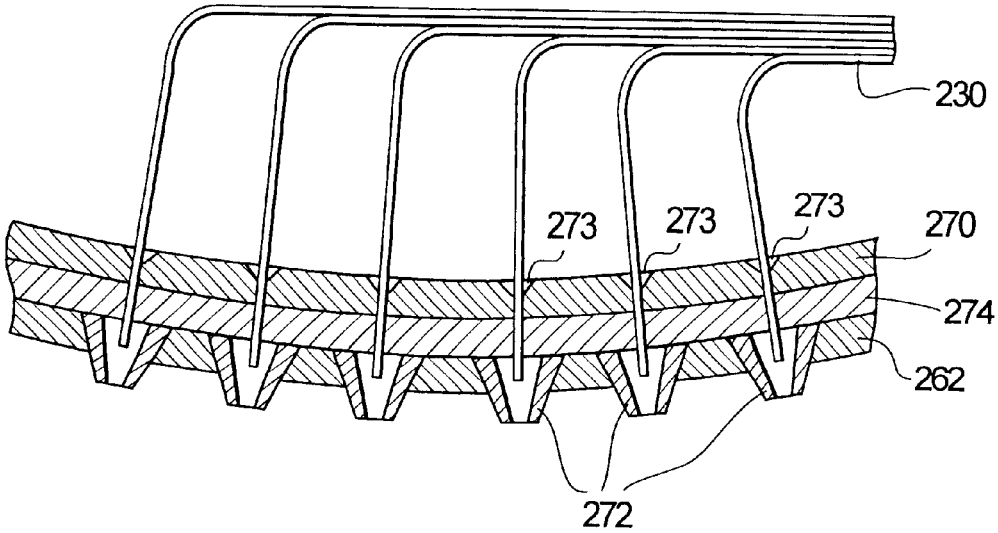
FIG. 4 illustrates the details of a light transmission channels to water coupling portion of the first exemplary embodiment of the present invention.

FIG. 4 illustrates the details of the connection between the individual fiber strands 230 as well as the individual spray elements. As shown in FIG. 4, a fiber-optic strands locating element 270 mechanically secures the individual fiber strands 230 in their respective appropriate locations over each of the corresponding water outlet nozzles 272. The fiber-optic strand locating element 270 may be comprised of a plastic member having a plurality of holes 273 which is secured such that each of the plurality of holes 273 is aligned over corresponding ones of the individual shower sprays 272. The purpose of the fiber-optic strand locating element 270 is simply to provide proper registration of individual fiber-optic strands 230 over the corresponding shower sprays. It will be recognized by those skilled in the art that the fiber-optic strand locating element 270 must be positioned such that there is a sufficient gap to allow water to flow through a water channel 274 so that water is emitted from sprays 272. As a result of the placement of individual fiber-optic strands directly above each of the individual water outlet openings or sprays 272, light is readily transmitted from each of individual fiber-optic strands 230 through the water emitted by each of the individual spray nozzles 272 in order to provide the desired effect. FIG. 4 illustrates the preferred relationship between the terminations of the individual fiber-optic strands 230 and the individual spray nozzles 272. It will be recognized by those skilled in the art that the individual fiber-optic strand elements do not necessarily need to extend into the water spray cavities of individual spray nozzles 272. Rather, these elements simply need to be located above the individual spray nozzles 272 in order to provide the appropriate transmission of light.

Figure 5:
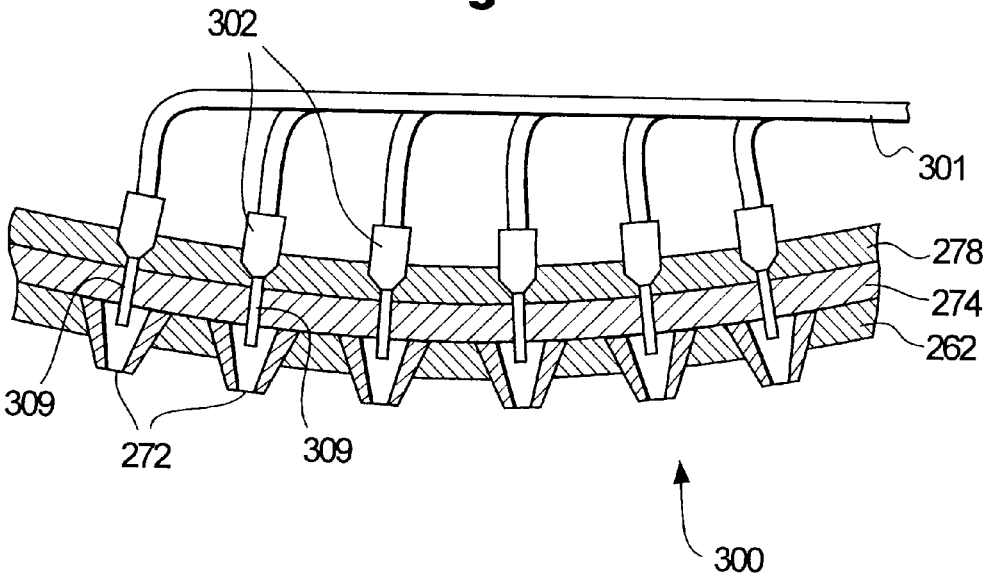
FIG. 5 illustrates the details of a light source to water coupling portion of an alternate exemplary embodiment of the present invention.

FIG. 5 illustrates an alternate preferred exemplary of embodiment of the present invention which is generally shown at 300. As shown in this illustration, a single individual light source is replaced by a plurality of individual light generating members which, in the preferred exemplary embodiment, is comprised of individual LED members 302. Electrical power is provided to the individual LED members 302 via insulated conductive wires 301. It is preferred that the electrical voltage present on insulated conductive wires 301 be relatively low in order to prevent any potential for electrical shock. In the preferred exemplary embodiment, fiber-optic strand locating element 270 is replaced by LED registration member 278 which provides for the appropriate mechanical registration of the individual LED members 302 over individual spray members 272. As in the previous embodiment, the required water transmission channel 274 is provided.

In the preferred exemplary embodiment illustrated in FIG. 5, individual fiber-optic strands 309 are placed between the individual LED elements 302 and the corresponding individual water outlet sprays or nozzles 272. These short fiber-optic strands 309 are utilized to transmit light from the individual LED members to corresponding ones of the individual water spray nozzles 272. It will be recognized by those skilled in the art that these individual short fiber-optic transmission strands 309 may be replaced by a lens member or other suitable light transmission member for transferring light from the LED members 302 to the water spray nozzles 272. Alternatively, the LED members may be placed directly above the individual water sprays 272.

Those skilled in the art will appreciate the various modifications and substitutions may be made for the elements described in the preferred exemplary embodiments without departing from the spirit and scope of the present invention. It should be recognized that the exemplary embodiments are illustrative only and should not in any way be construed to limit the scope of the present invention as defined in the following claims.

We claim:

1. An illuminated shower head comprising:

a plurality of water outlet orifices; and a plurality of sources of illumination, each of the plurality of sources of illumination being located adjacent to corresponding ones of the plurality of water outlet orifices such that light emitted from each of the plurality of sources of illumination passes rough the corresponding ones of the plurality of water outlet orifices.

2. The illuminated shower head of claim 1, further comprising a light transmission element located between individual ones of the plurality of sources of illumination and the corresponding ones of the plurality of water outlet orifices, the light transmission element for transmitting light emitted from the individual ones of the plurality of sources of illumination through the corresponding ones of the plurality of water outlet orifice.

3. The illuminated shower head of claim 2, wherein the light transmission element is a fiber-optic element.

4. The illuminated shower head of claim 2, wherein the light transmission element is a lens element.

5. The illuminated shower head of claim 1, wherein the plurality of sources of illumination comprise a plurality of light emitting diodes (LEDs).

6. The illuminated shower head of claim 1, further comprising a registration member for mechanically positioning each of the plurality of sources of illumination over the corresponding ones of the plurality of water outlet orifices.

* * * * *